US005397604A

United States Patent [19]

Phillips, III et al.

[11] Patent Number: 5,397,604

[45] Date of Patent: Mar. 14, 1995

[54] NON-CONTACT FLUID APPLICATOR APPARATUS AND METHOD

[75] Inventors: Robert P. Phillips, III, Staatsburg; Norman J. Dauerer; Peter Elenius, both of Hopewell Junction, all of N.Y.; Brian M. Kerrigan, Austin, Tex.; Helmut Krueger, Pleasant Valley, N.Y.; Robert O. Lussow, Don Mills, Canada

[73] Assignee: International Business Machines Corporation, Armonk, N.Y.

[21] Appl. No.: 161,894

[22] Filed: Dec. 3, 1993

[51] Int. Cl.[6] ..... B05D 1/18

[52] U.S. Cl. ..... 427/430.1; 427/331

[58] Field of Search ..... 427/331, 430.1; 118/263, 266

[56] References Cited

U.S. PATENT DOCUMENTS

| | | | |
|---|---|---|---|
| 2,382,949 | 8/1945 | McLaren . | |
| 2,514,009 | 7/1950 | Raspet . | |
| 3,853,663 | 12/1974 | McGlashen | 427/284 |
| 3,952,697 | 4/1976 | Bonkoske | 118/263 |
| 4,158,076 | 6/1979 | Wallsten | 427/294 |
| 4,275,656 | 6/1981 | Choma | 101/211 |
| 4,569,305 | 2/1986 | Ferri et al. | 118/263 |
| 4,802,554 | 2/1989 | Takayama et al. | 118/263 |

OTHER PUBLICATIONS

Galindo et al., "Method for Photo Resist Application", IBM Technical Disclosure Bulletin, vol. 13, No. 5, p. 1266 Oct. 1970.

T. H. Jaeger, et al., "Casting Technique For Large Area, Thin Films of Polymer Solutions": IBM Technical Disclosure Bulletin, vol. 22, No. 2, pp. 836–837 (Jul. 1979).

*Primary Examiner*—Shrive Beck
*Assistant Examiner*—David M. Maiorana
*Attorney, Agent, or Firm*—Aziz M. Ahsan

[57] ABSTRACT

This invention is an improved method and apparatus for applying fluids onto a selected area of a component. The method uses a thin film or membrane formed by placing a forming tool in the fluid to be applied. A thin film or membrane is formed across the forming tool, which is analogous to a soap bubble formed across a bubble wand dipped into a soap bubble solution. The thin film is brought into contact with the area of the component to be coated thereby resulting in the transfer of the thin film onto the component and a variation of the thin fluid film or membrane forming tool that allows for a continuous feed application.

42 Claims, 5 Drawing Sheets

NON-CONTACT FLUID APPLICATOR APPARATUS AND METHOD

FIELD OF THE INVENTION

The present invention relates generally to an apparatus and methods using non-contact fluid applicators. More particularly, the invention encompasses an apparatus and method that allows the deposition of at least one layer of a liquid film over a member, such as a rod or a substrate.

BACKGROUND OF THE INVENTION

Today, typical component preparation fluid applicators whether it is for an electronic component, mechanical component or optical component, all require some type of mechanical applicator to come in contact with the component. This mechanical applicator will usually coat or brush preparation fluids onto the selected surface of a component. In other embodiments, component preparation fluid applicators spray or sprinkle preparation fluids onto the selected surface of a component to be processed. Although these contact systems and spray systems are relatively easy to implement in a production environment, these systems have several inherent disadvantages. To begin, the contact or spray systems have a limited ability in which to control the thickness of the fluid being applied. Next, scatter and over spray often contaminate surrounding regions. The removal of the contamination is usually based on a cleaning process or step. Cleaning from a production manufacturing view point is widely regarded as a "no value add" to the manufacturing process, that is, the component had to undergo the additional step of cleaning because a previous process step was imperfect in its inherent ability to apply preparation fluid to a particularly selected surface.

The present invention is an improved method and apparatus for applying preparation fluids onto components. The present invention maintains the simple implementation characteristics of today's contact applicators while overcoming their inherent limitations. The limitations of today's fluid applicators overcome by the present invention includes the ability to precisely regulate the thickness of the application fluid and the elimination of over spray and the contamination of surrounding areas.

BACKGROUND ART

The following references relate to various methods for applying fluid coatings:

U.S. Pat. No. 3,853,663, issued Dec. 10, 1974, to McGlashen for "Application of Liquid Coatings" appears to disclose a method and apparatus to coat liquids onto selected areas of the surface of an object. The tool corresponds in shape to the selected area of the object to be coated. Raising the tool without breaking the surface of the liquid causes the liquid above the tool to rise and contact the article in the selected areas only.

U.S. Pat. No. 4,275,656, issued Jun. 30, 1981, to Choma for "Bubble Printing Method" appears to disclose a method for printing on textiles which employs a substantially ordered array of bubbles, each individually formed and colored, to carry the colorant to the surface being printed and to form the desired pattern on the surface.

U.S. Pat. No. 4,158,076, issued Jun. 12, 1979, to Wallsten for "Coating Delivered as Bubbles" appears to disclose a method of treating a surface with a solution, the solution is foamed under pressure and delivered via a passageway to an application zone so as to come into close proximity with the surface to be treated.

U.S. Pat. No. 2,514,009, issued Jul. 4, 1950, to Raspet for "Bubble-Forming Device" appears to disclose a bubble-forming wand comprising a handle and bubble forming ring. The ring having a multiplicity of strands of rigid material so as to form capillary spaces between the strands and the ring.

U.S. Pat. No. 2,382,949, issued Aug. 14, 1945, to McLaren for "Bubble Forming Device" appears to disclose an improved device for forming bubbles by waving the device through the air.

IBM Technical Disclosure Bulletin, Vol. 13, No. 5 , page 1266 (October 1970), discloses a method for photo resist application where a rigid frame which is larger than the diameter of a wafer or substrate is submerged in a photoresist solution and withdrawn to form a wet film of resist across the circumference of the frame. The frame and film is then placed over the substrate so that the film contacts the substrate surface and transfers to it when the film separates from the ring.

IBM Technical Disclosure Bulletin, Vol. 22, No. 2, pages 836–837 (July 1979), discloses a casting technique for large area, thin films of polymer solutions. The method involves drawing a droplet from a reservoir and passing a bar through the droplet and drawing the fluid out over the opening of the ring in the form of a film, while maintaining fluid contact between the edges and the wiper bar.

PURPOSES AND SUMMARY OF THE INVENTION

The invention is a novel method and an apparatus for applying a thin coating of a liquid film over the surface of a member.

Therefore, one purpose of this invention is to provide an apparatus and a method that will provide an improved method of applying preparation fluids to the surface of a component.

It is another purpose of the present invention to provide an improved method for applying fluids to a surface of a component.

It is yet another purpose of this present invention to provide an improved method of applying fluids to as elected surface of a component, thereby reducing excess fluid usage.

It is still another purpose of this present invention to provide an improved method of controlling the thickness of the fluid layer applied to the surface of a component.

It is still a further purpose of this present invention to provide a method of applying adhesives to optical lenses during optical assembly.

It is yet still another purpose of this present invention to provide a method of applying lubricants to mechanical members.

Lastly, but not limited hereto, it is a purpose of the present invention to extend and promote packaging design for components requiring preparatory fluids.

In one aspect this invention comprises an apparatus for applying fluid onto a component, said apparatus comprising: a thin film forming member; a reservoir for holding said fluid to be applied and sized to accommodate said thin film forming member; a movement means for moving said thin film forming member from a first position, wherein said thin film forming member is submersed into said fluid contained in said reservoir so as to form a fluid film thereon, to a second position wherein said fluid film formed on said thin film forming member contacts said component such that at least a portion of said fluid film formed on said thin film forming member transfers onto at least a portion of said component.

In another aspect this invention comprises an apparatus for applying fluid onto components, said apparatus comprising:

a thin film forming member; a reservoir accommodating said forming member, said reservoir having a through-hole and a curb disposed around said through-hole to contain a fluid to be applied inside said reservoir; said thin film forming member having a first position in said reservoir and a second position which is elevated from said first position; a rotation means for rotating said forming member from its first position, wherein said forming member is submersed into said fluid contained in said reservoir to its second position wherein a fluid film is formed between said forming member and said fluid over said curb; a movement means for moving a component into contact with said fluid film formed by said thin film forming member resulting in the transfer of at least a portion of said thin film onto at least a portion of said component.

In yet another aspect this invention comprises a method of applying fluid onto a component, said method comprising: placing a thin film forming member into a fluid containing reservoir and moving it out of said reservoir to form a fluid film and applying said fluid film onto at least a portion of said component.

In still another aspect this invention comprises a method of applying a coating of a fluid onto components, said method comprising:

a) dipping a fluid membrane forming member in a reservoir having a through-hole and a curb disposed around said through-hole to contain a fluid to be applied inside said reservoir;

b) said fluid membrane forming member having a first position in said reservoir and a second position which is elevated from said first position;

c) rotating said fluid membrane forming member from its first position, wherein said forming member is submersed into said fluid contained in said reservoir to its second position wherein a fluid membrane is formed between said fluid membrane forming member and said fluid over said curb;

d) moving a component into contact with said fluid membrane formed by said fluid membrane forming member resulting in the transfer of a portion of said fluid membrane onto a portion of said component.

The foregoing and other purposes, features and advantages of the invention will be apparent from the following more particular description of the preferred embodiment of the invention as illustrated in the drawings.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DETAILED DESCRIPTION OF THE INVENTION

Primarily, the present invention relates to techniques and structures for the application of preparation fluids on a component prior to assembly. Examples of preparation fluids applied to components prior to assembly in this present invention includes: lubricants applied to sliding members and movable components in mechanical systems; adhesives applied to optical lenses and components in optical lens assemblies; thermal pastes which aid in the conduction of heat applied to electronic packaging components; and solder fluxes applied to electronic components prior to soldering. More particularly for this invention, the electronics packaging field will be the primary field of concentration. It should be distinctly pointed out, however, that several other fields including the aforementioned optics and mechanical systems fall within in the true spirit and scope of this present invention. Focusing now on the field of electronic packaging, the field of electronic packaging can be divided into several different principal areas of concentration. One principal area of concentration is the exploration into increasing the density of the integrated circuit components themselves. Another principal area of concentration is the exploration into increasing the density of integrated components mounted on substrates, thereby reducing the distances between the integrated electronic circuits. Due to advances in these two aforementioned electronic packaging areas in conjunction with others not mentioned, the density of the electronic package has continued to dramatically increase. As the components themselves have grown smaller and the packing distance between components is shrinking, the need to adequately prepare these smaller components before joining has also grown.

Figure 1:
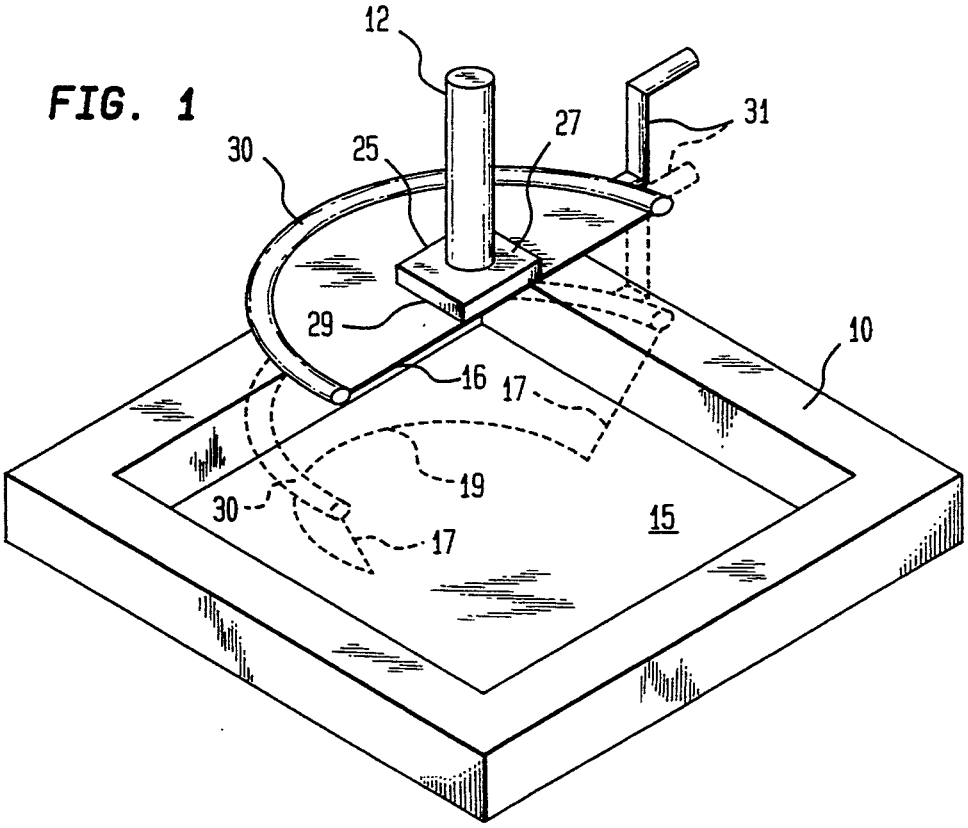
FIG. 1 is a perspective representation of a Non-Contact Fluid Applicator.

Referring now to the drawings where FIG. 1, shows a perspective representation of a fluid container or reservoir 10, with an opening on the top side for holding the fluid 15, to be applied. A component 25, having a first surface 27, and a second surface 29, wherein the first surface 27, is held in a position above reservoir 10, by a vacuum probe 12, such that the second surface 29, on which a fluid coating will be applied faces the reservoir 10. A tube or ring or loop 30, such as a wire-type loop 30, is attached to Z motion member 31, movable along an axis which is perpendicular to the top opening of the reservoir 10. The Z motion member 31, has a first position, the submersion position which is below the fluid level 19, wherein the attached wire loop 30, is submerged into the fluid 15, preferably to a depth of at least half the thickness of the wire loop 30. The Z motion member 31, is moved out of fluid 15, in reservoir 10, up to a second position, the application position, which is above the fluid level 19. During the movement of Z motion member 31, from the submersed position to the application position, a taffy type pull 17, happens and a thin fluid film or membrane 16, forms from fluid 15, across the wire loop 30. In the application position, wire loop 30, with thin fluid film or membrane 16, is positioned so as to contact at least a portion of the second surface 29, of component 25, thereby coating at least a portion of the surface 29, with at least a portion of the thin fluid film membrane 16. It has been shown that wire loop 30, can be changed in size or shape to more closely conform with the surface of surface 29, of the component 25. Various common geometries including a square, rectangle, triangle as well as specialized geometries have been demonstrated with the wire loop 30. In addition, the thickness of the desired thin film membrane 16, can be varied to some extent by the geometry of wire loop 30, but to a greater extent by the viscosity of the fluid 15, which has been shown to be affected by atmospheric environmental factors such as temperature and humidity. Hence, through the choice of certain application fluids and the control of atmospheric conditions during application, the thickness of the resulting thin film can be closely regulated.

Figure 2:
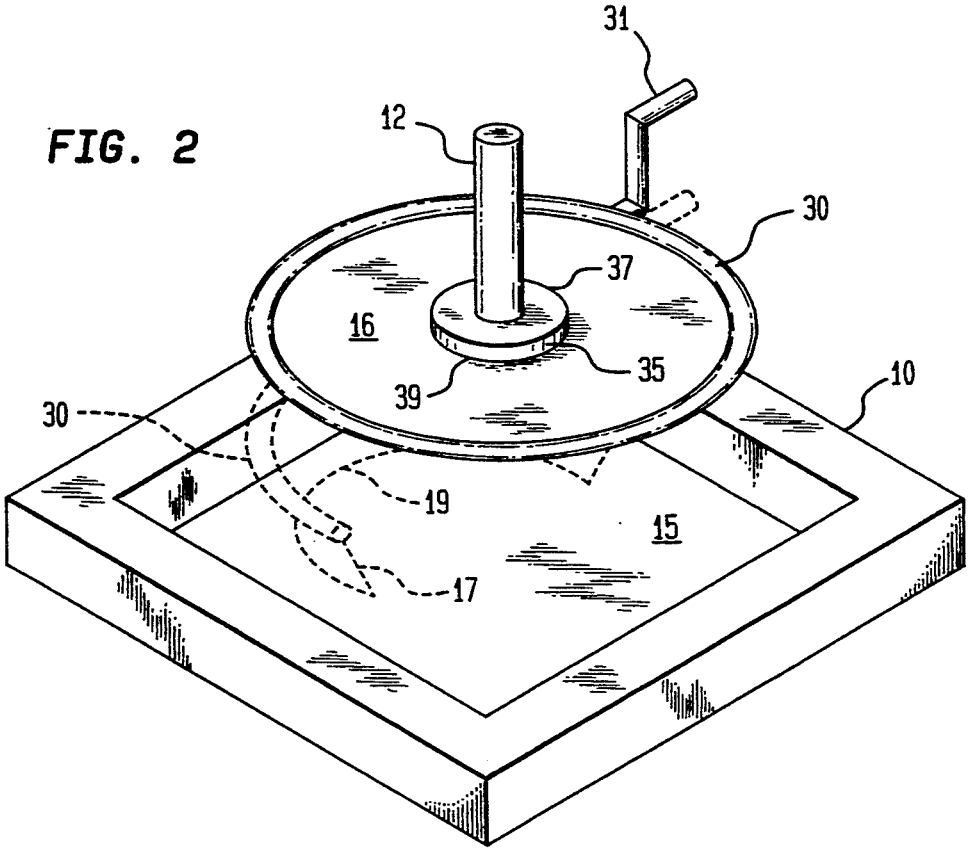
FIG. 2 is a perspective representation of another embodiment of the Non-Contact Fluid Applicator for an optical lens member.

Referring now to FIG. 2, which illustrates that a component 35, to be coated is an optical lens component 35, and fluid 15 an adhesive. The lens 35, has a first surface 37, that is held securely by a probe 12, such as a vacuum probe 12, while a second surface 39, comes in contact with a portion of the adhesive fluid film 16, held by the loop 30, and the fluid adhesive film 16, is applied to at least a portion of the lens surface 39. This method of applying a adhesive fluid coating over a lens to subsequently form an optical lens assembly, is an ideal adhesive application, as a very thin film having little or no air bubbles or pockets of trapped air, can be applied to the surface of the lens 35. A person skilled in the art can fully appreciate that air bubbles or pockets of trapped air on the surface of a lens can be very detrimental to the optical characteristics of that lens or the lens assembly.

Figure 3:
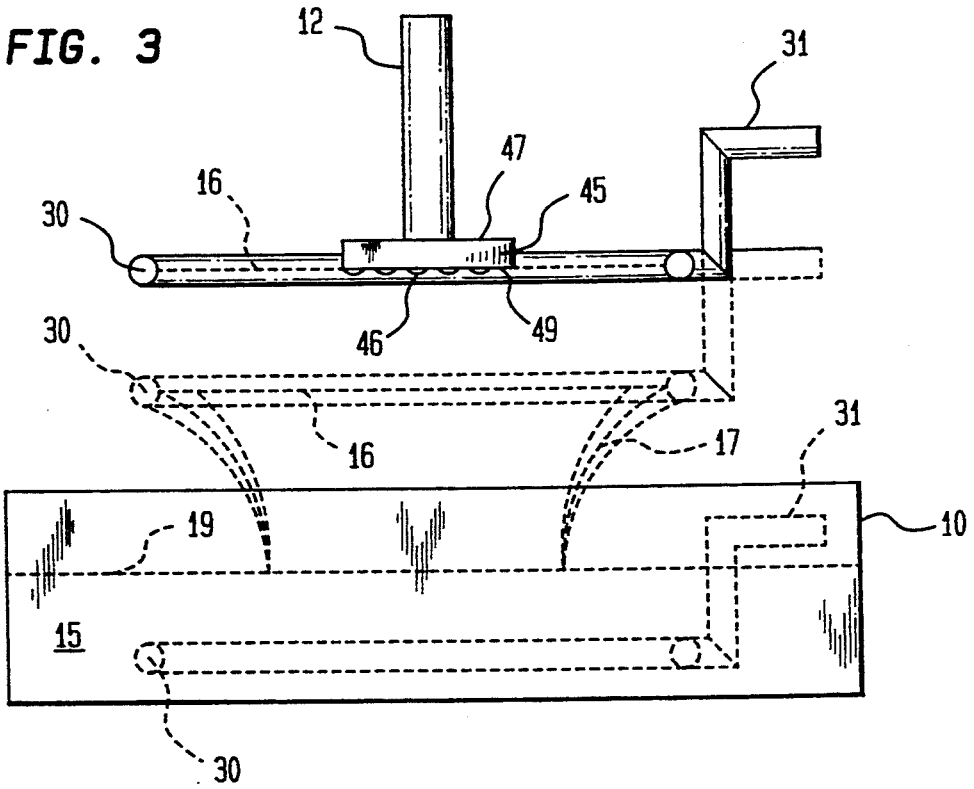
FIG. 3 is a sectional representation of FIG. 1, for the Non-Contact Fluid Applicator on a component being joined through a C4 solder mounting method.

FIG. 3, illustrates another application of the invention, wherein a component 45, having a first surface 47, and a second surface 49. The first surface 47, is securely held by a probe 12, while the second surface to be coated 49, with a thin film membrane 16, has a plurality of solder balls or C4s (Controlled Collapsed Chip Connections) 46. The second surface 49, having the C4s or solder balls 46, on the electronic component 45, are coated with a layer of fluid from the fluid membrane 16, prior to joining the component 45, through soldering onto a substrate. The C4 solder mounting method has seen a resurgence of use with the advent of multi-chip modules and the ever shrinking electronic packing methods. For such C4 or solder ball applications the fluid 15, is typically a flux.

Figure 4:
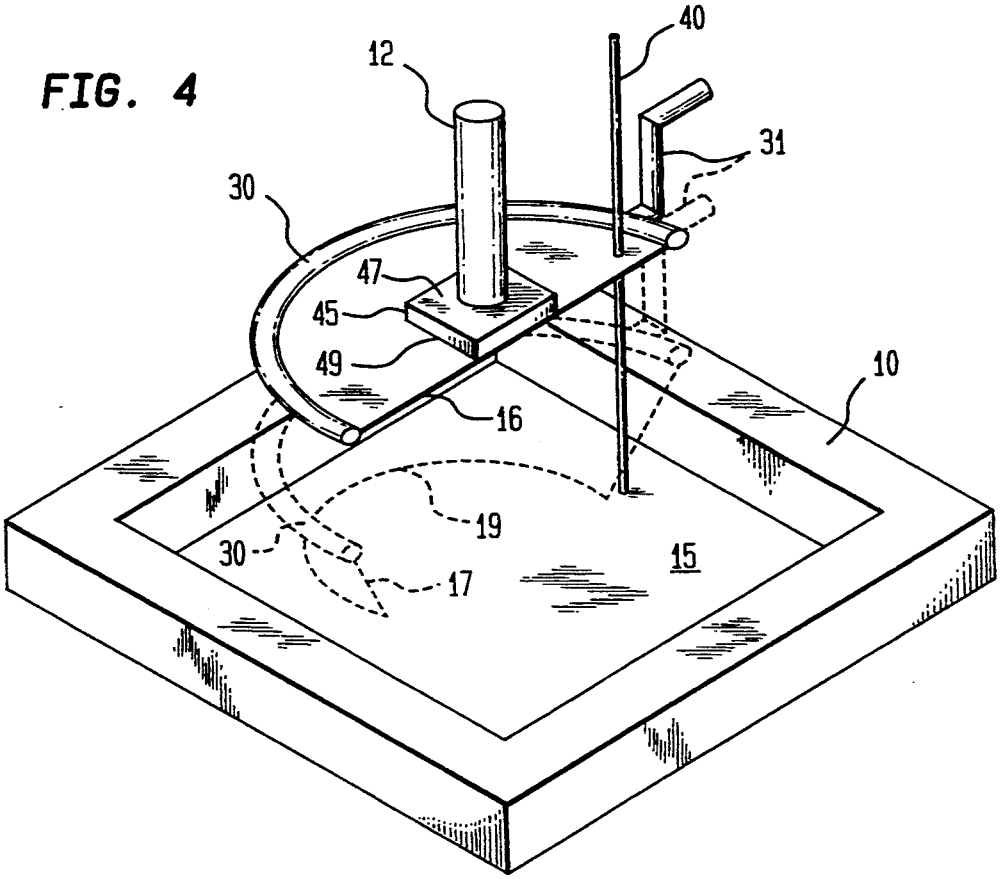
FIG. 4 is a perspective representation of another embodiment of the Non-Contact Fluid Applicator having a droplet control rod.

FIG. 4, illustrates a further embodiment of the present invention. In FIG. 4, a droplet rod 40, gently penetrates the fluid film membrane 16, and when the thin film membrane 16, is broken after application of the fluid film on the surface 49, of component 45, the droplet rod 40, controls the dispersion of the fluid 15. The droplet rod 40, provides a conduit for any excessive fluid 15, during the application to be channeled down droplet rod 40, back to the fluid container or reservoir 10. The use of the droplet rod 40, allows the excess fluid to gently and in a controlled manner drain back into the reservoir 10, instead of beading at the surface of the component 45, or at the inner peripheral surface of the loop or ring 30. This droplet rod 40, of course can be used with any of the method or embodiments of the present invention.

Figure 5:
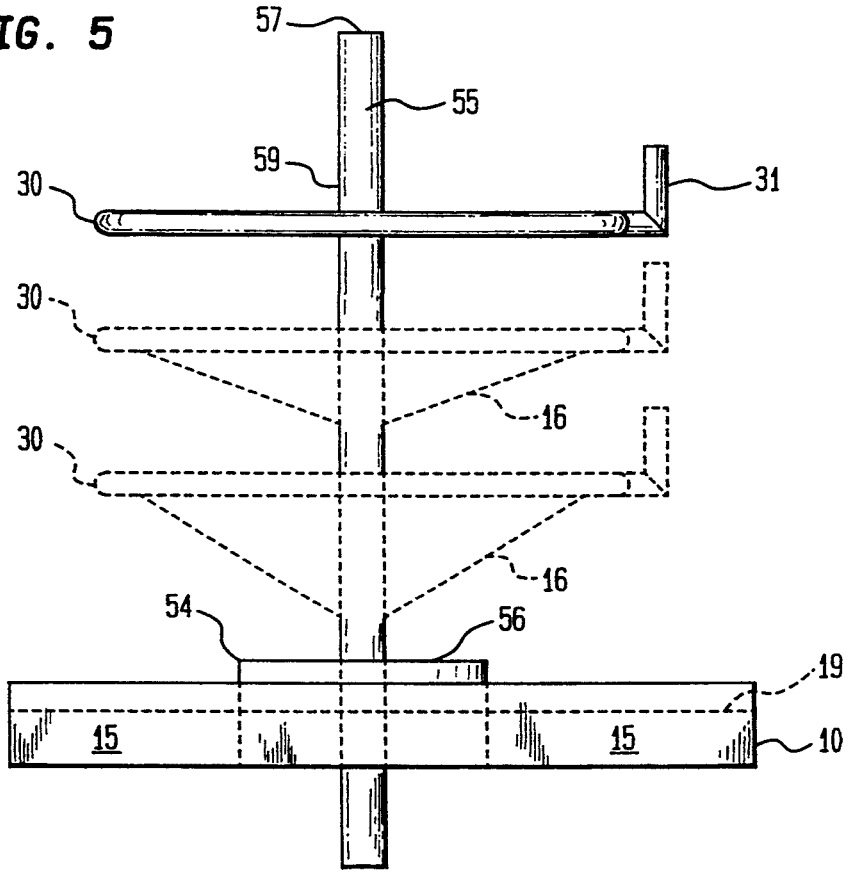
FIG. 5 is a side representation of FIG. 1 for the Non-Contact Fluid Applicator on a cylindrical member.
Figure 6:
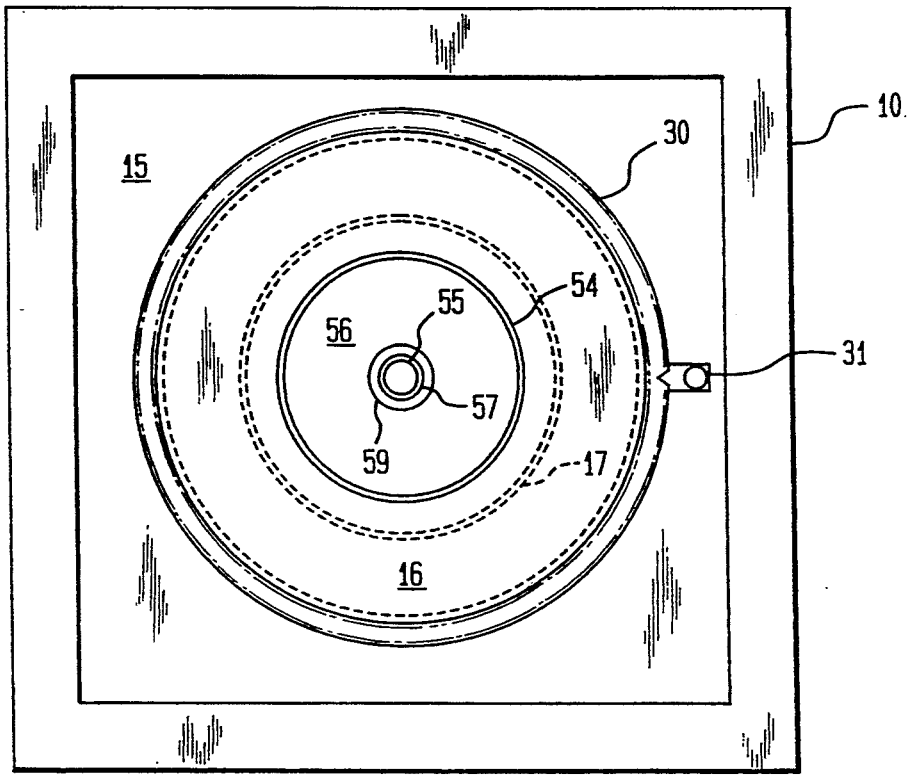
FIG. 6 is a top view representation of the Non-Contact Fluid Applicator of FIG. 5.

FIGS. 5 and 6, illustrate another embodiment of the present invention. In FIG. 5, the component to be coated 55, is cylindrical, having a first surface 57, and a second surface 59. The wire loop 30, having Z motion member 31, is moved along the cylindrical component 55, coating the second or outer surface 59. Loop 30, can be changed in size or shape to more closely fit the surface 59, of the component 55, to be coated.

As illustrated in the FIGS. 5 and 6, the reservoir 10, may have a through hole 56, having a curb 54, for confining the fluid 15, and also for keeping the component 55, out of fluid 15. FIGS. 5 and 6, depict a curb 54, with a component or through hole 56, through the lower surface or base of the reservoir 10, for accepting an elongated component of any desired length. The component or through hole 56, enables coating the complete or portion of the length of the component 55, by either moving the component 55, through the loop or ring 30, having the membrane or thin fluid film 16, successively along its axial direction through component hole 56, inside the curb 54, or moving the loop or ring 30, having the thin fluid film or membrane 16, as shown in FIG. 5.

Figure 7:
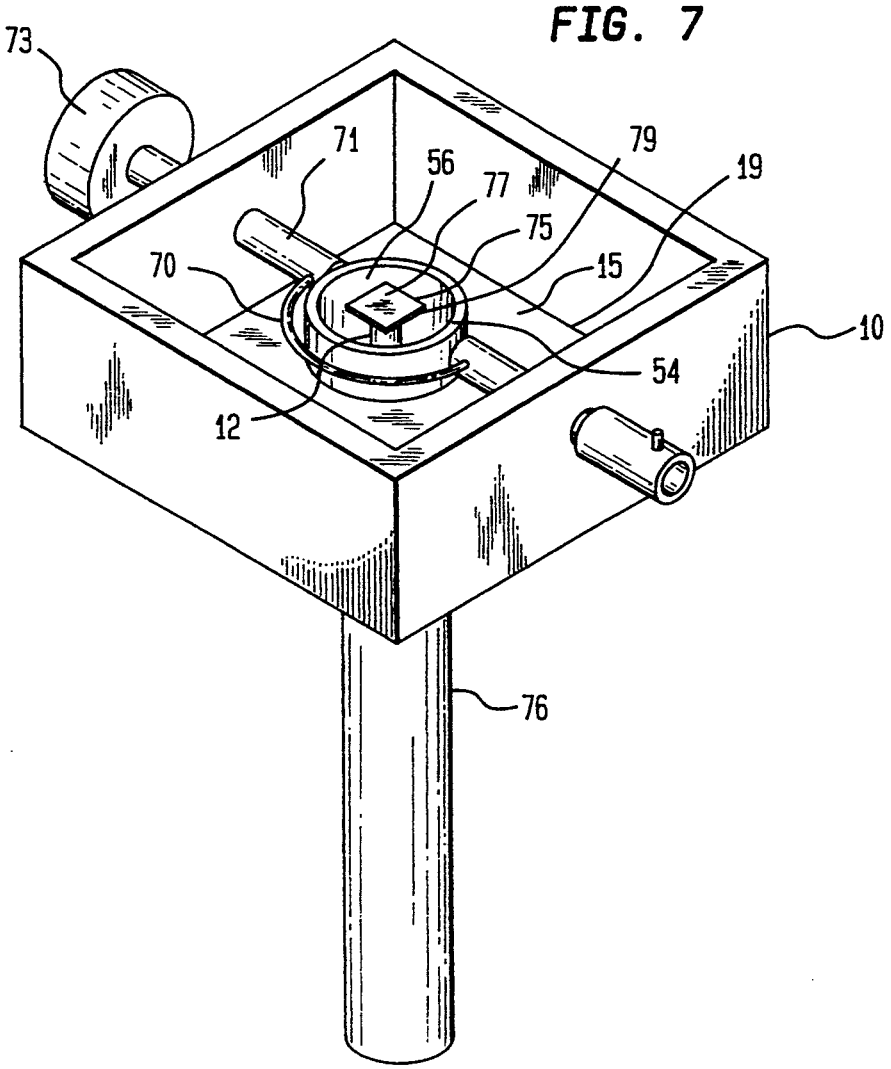
FIG. 7 is a perspective representation of another embodiment of the Non-Contact Fluid Applicator using a rotating arc shaped forming member with the component to be coated presented from the bottom.
Figure 8:
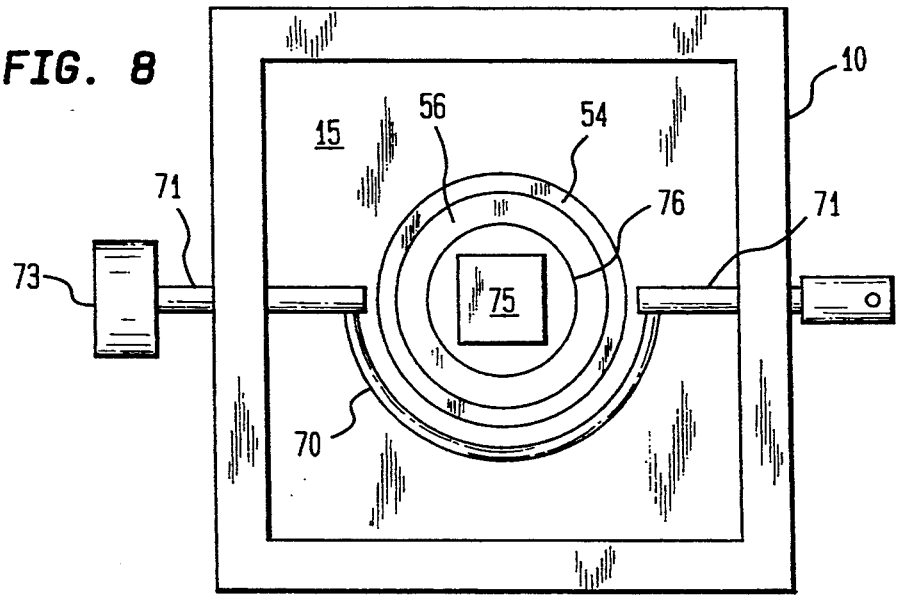
FIG. 8 is a top view of the embodiment illustrated in FIG. 7.

FIGS. 7 and 8, illustrate yet another embodiment of the invention, where an arc shaped member 70, having a rotational arm 71, and rotational means 73, is used to apply the fluid coating on a member or component 75. The component 75, having a first surface 77, and a second surface 79, is introduced from the bottom of the reservoir 10, through a through opening 56, inside the curb 54, by vacuum probe 12, which is attached to a displacement cylinder 76. Cylinder 76, extends to an upper application position wherein the first surface 77, of the component 75, is placed just above the highest point on curb 54. This slightly elevated position with reference to curb 54, ensures that the surface 77, will receive a thin film membrane pulled across it by the arc-shaped member 70. The thin fluid film 16, is formed by a "pulling" motion, which is analogous to the effect of pulling taffy candy, by the arc-shaped member 70. The arc-shaped member 70, is preferably submerged into the fluid container or reservoir 10, below the fluid level 19, and the resulting thin fluid film 16, is pulled across the first surface 77, of the component 75, and thereby a portion of the first surface 77, gets a coating of the fluid film 16. One advantage of this embodiment is that the component 75, does not have to be moved for multiple coating or application of the fluid film 16. For each coating the arc-shaped member 70, is dipped in the fluid 15, and made to rotate approximately 180 degrees using rotational arm 71, and rotational means 73. As the arc-shaped member 70, goes across component 75, it deposits a fluid film on the first surface 77. Similarly, on the return trip the arc-shaped member 70, picks up a fluid film 16, from the other side and brings it across the component 75, and deposits another layer of fluid film on the first surface 77. This going back and forth results in multiple coating on the surface of the component 75, without ever moving the component.

Not illustrated would be another embodiment of the present invention where the second surface 79, of the component 75, to be coated is introduced from the top of the reservoir 10, while the first surface 77, is securely held by a vacuum probe 12, and this whole assembly is placed into the application position by a displacement cylinder 76. Of course for each coating the component 75, would have to be moved away from the reservoir 10, while the arc-shaped member 70, dips in and out of the fluid bath 15, and has been replenished with a fluid membrane 16, to be applied onto the surface of the component 75, for a plurality or multiple fluid coatings.

A further embodiment of the invention of the non-contact fluid applicator overcomes one of the problems arising from the use of the single wire loop and that is the quantity of available liquid or fluid in the static condition after having loaded the ring or loop 30, from the fluid or coating reservoir 10. For the purposes of illustration, as the vertical member or component 55, of FIG. 5, is drawn through the ring or loop 30, the liquid or fluid coats the member or component 55, but may run out of sufficient quantity of coating fluid 15, depending upon the size of the item or component being coated, viscosity of the liquid, size of the ring or loop, etc. Building on the wire loop principle (that holds fluid through surface tension having been drawn from a reservoir) and the principle of drawing a vertical member 55, through the suspended liquid we come to the principle of continuous feeding of the liquid by means of the ring or loop or tube. A continuous flow can alleviate this type of a problem.

Figure 9:
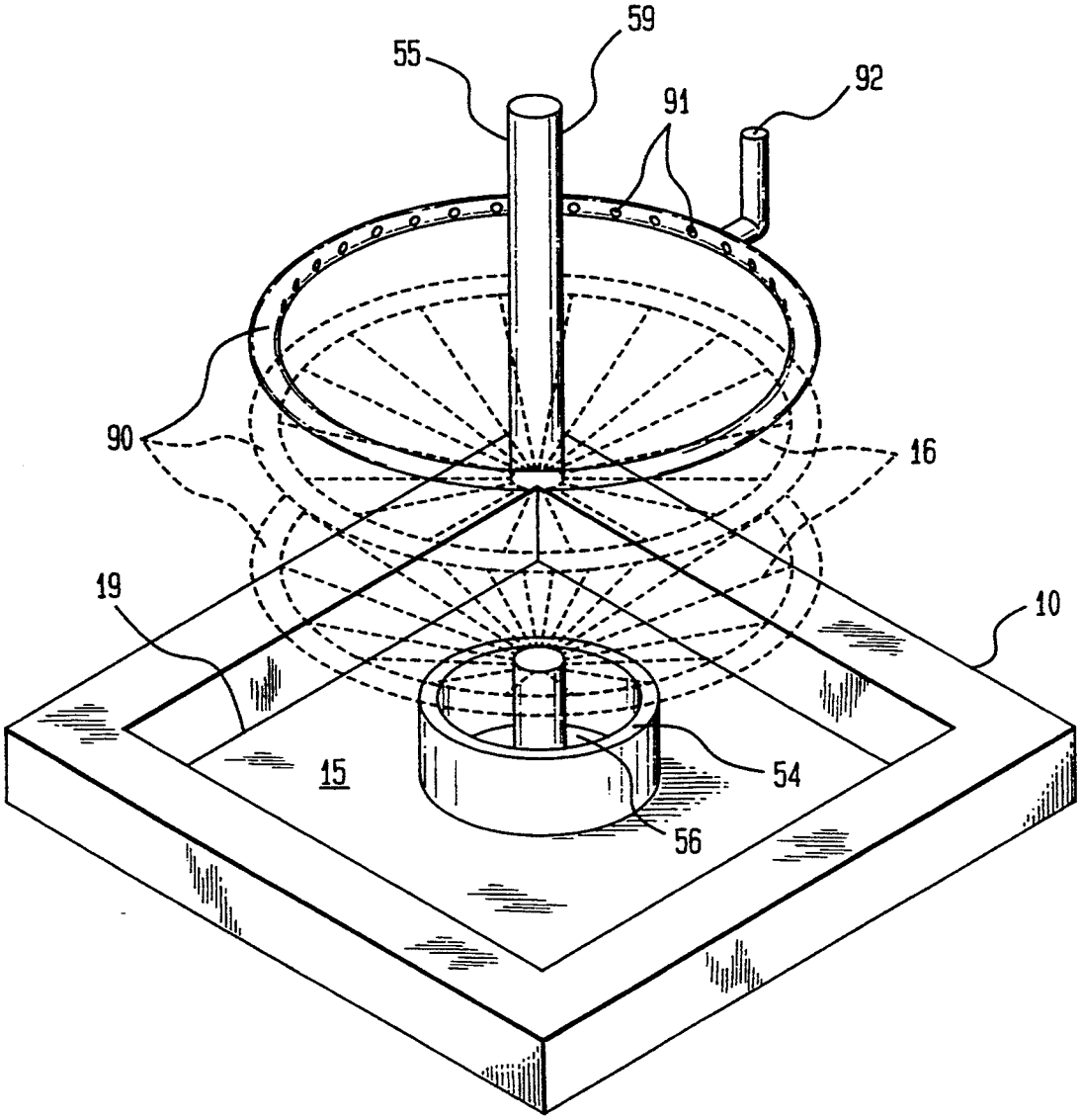
FIG. 9 is a perspective representation of another embodiment of the Non-Contact Fluid Applicator showing a fluid applicator having a plurality of openings in support of continuous flow application.

FIG. 9, addresses the continuous flow capability of the loop or tube or ring applicator 90, enabling it to apply a continuous coating to any vertical member being drawn through the center of the ring 90. By constructing the ring 90, using a hollow tube (size and diameter determined by the object size and liquid viscosity being applied), that has holes or openings, such as pin-holes, toward the center of the ring, will allow for a continuous feed of the coating liquid 15, as it is being used up. Construction, size and number of the ring feeder holes 91, can vary. The openings need not be holes but could also be a continuous opening on the inner diameter of the ring, i.e., a slit along the entire inside circumference. Of course the applicator 90, having at least one hole or opening 91, can be used With any of the methods or embodiments of the present invention.

For some applications the coating fluid 15, could be fed through the feeder tube 92, to the applicator 90, on a continuous basis, or the inside cavity of the applicator 90, could act as a mini or temporary reservoir for the fluid 15, as the fluid is being extracted by the depletion of the fluid contained in the fluid membrane or film 16, through the one or more ring feeder holes 91.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

What is claimed is:

1. An apparatus for applying fluid onto a component, said apparatus comprising: a thin film forming member; a reservoir for holding said fluid to be applied and sized to accommodate said thin film forming member; a movement means for moving said thin film forming member from a first position, wherein said thin film forming member is submersed into said fluid contained in said reservoir so as to form a fluid film thereon, to a second position wherein said fluid film formed on said thin film forming member contacts said component such that at least a portion of said fluid film formed on said thin film forming member transfers onto at least a portion of said component, and wherein said thin film forming member has at least one opening for the feeding of said fluid to be applied.

2. The apparatus of claim 1, wherein said thin film forming member is a ring.

3. The apparatus of claim 1, wherein said component is an electronic component having solder balls and said fluid is a flux to coat at least a portion of said solder balls.

4. The apparatus of claim 1, wherein said component is an optical lens.

5. The apparatus of claim 1, wherein said fluid is an adhesive.

6. The apparatus of claim 1, wherein said fluid is a flux.

7. The apparatus of claim 1, further comprising at least one droplet rod which penetrates said fluid film and enables the draining of excess fluid back into said reservoir.

8. The apparatus of claim 1, wherein said reservoir contains a curb therein for keeping said fluid away from said component.

9. The apparatus of claim 8, wherein said curb inside said reservoir contains a through hole.

10. An apparatus for applying fluid onto components, said apparatus comprising:

a thin film forming member; a reservoir accommodating said forming member, said reservoir having a through-hole and a curb disposed around said through-hole to contain a fluid to be applied inside said reservoir; said thin film forming member having a first position in said reservoir and a second position which is elevated from said first position; a rotation means for rotating said forming member from its first position, wherein said forming member is submersed into said fluid contained in said reservoir to its second position wherein a fluid film is formed between said forming member and said fluid over said curb; a movement means for moving a component into contact with said fluid film formed by said thin film forming member resulting in the transfer of at least a portion of said thin film onto at least a portion of said component.

11. The apparatus of claim 10, further comprising at least one droplet rod which penetrates said fluid film and enables the draining of excess fluid back into said reservoir.

12. The apparatus of claim 10, wherein said thin film forming member is a ring.

13. The apparatus of claim 10, wherein said component is an electronic component having solder balls and said fluid is a flux to coat at least a portion of said solder balls.

14. The apparatus of claim 10, wherein said component is an optical lens.

15. The apparatus of claim 10, wherein said fluid is an adhesive.

16. The apparatus of claim 10, wherein said thin film forming member has at least one opening for the feeding of said fluid to be applied.

17. The apparatus of claim 10, wherein said fluid is a flux.

18. The apparatus of claim 10, further comprising at least one droplet rod which penetrates said fluid film and enables the draining of excess fluid back into said reservoir.

19. The apparatus of claim 10, wherein said reservoir contains a curb therein for keeping said fluid away from said component.

20. The apparatus of claim 19, wherein said curb inside said reservoir contains a through hole.

21. A method of applying fluid onto a component, said method comprising: placing a thin film forming member into a fluid containing reservoir and moving it out of said reservoir to form a fluid film and applying said fluid film onto at least a portion of said component, and wherein said thin film forming member has at least one opening for the feeding of said fluid to be applied.

22. The method of claim 21, wherein said thin film forming member is a ring.

23. The method of claim 21, wherein said component is an electronic component having solder balls and said fluid is a flux to coat at least a portion of said solder balls.

24. The method of claim 21, wherein said component is an optical lens.

25. The method of claim 21, wherein said fluid is an adhesive.

26. The method of claim 21, wherein said fluid is a flux.

27. The method of claim 21, further comprising at least one droplet rod which penetrates said fluid film and enables the draining of excess fluid back into said reservoir.

28. The method of claim 21, wherein said reservoir contains a curb therein for keeping said fluid away from said component.

29. The method of claim 28, wherein said curb inside said reservoir contains a through hole.

30. A method of applying a coating of a fluid onto components, said method comprising:

a) dipping a fluid membrane forming member in a reservoir having a through-hole and a curb disposed around said through-hole to contain a fluid to be applied inside said reservoir;

b) said fluid membrane forming member having a first position in said reservoir and a second position which is elevated from said first position;

c) rotating said fluid membrane forming member from its first position, wherein said forming member is submersed into said fluid contained in said reservoir to its second position wherein a fluid membrane is formed between said fluid membrane forming member and said fluid over said curb;

d) moving a component into contact with said fluid membrane formed by said fluid membrane forming member resulting in the transfer of a portion of said fluid membrane onto a portion of said component.

31. The method of claim 30, further comprising at least one droplet rod which penetrates said fluid membrane and enables the draining of excess fluid back into said reservoir.

32. The method of claim 30, wherein said thin film forming member is a ring.

33. The method of claim 30, wherein said component is an electronic component having solder balls and said fluid is a flux to coat at least a portion of said solder balls.

34. The method of claim 30, wherein said component is an optical lens.

35. The method of claim 30, wherein said fluid is an adhesive.

36. The method of claim 30, wherein said thin film forming member has at least one opening for the feeding of said fluid to be applied.

37. The method of claim 30, wherein said fluid is a flux.

38. The method of claim 30, further comprising at least one droplet rod which penetrates said fluid film and enables the draining of excess fluid back into said reservoir.

39. The method of claim 30, wherein said reservoir contains a curb therein for keeping said fluid away from said component.

40. The method of claim 39, wherein said curb inside said reservoir contains a through hole.

41. An apparatus for applying fluid onto a component, said apparatus comprising: a thin film forming member; a reservoir for holding said fluid to be applied and sized to accommodate said thin film forming member; a movement means for moving said thin film forming member from a first position, wherein said thin film forming member is submersed into said fluid contained in said reservoir so as to form a fluid film thereon, to a second position wherein said fluid film formed on said thin film forming member contacts said component such that at least a portion of said fluid film formed on said thin film forming member transfers onto at least a portion of said component, and wherein said apparatus further comprises at least one droplet rod which penetrates said fluid film and enables the draining of excess fluid back into said reservoir.

42. A method of applying fluid onto a component, said method comprising: placing a thin film forming member into a fluid containing reservoir and moving it out of said reservoir to form a fluid film and applying said fluid film onto at least a portion of said component, and wherein said method further comprises at least one droplet rod which penetrates said fluid film and enables the draining of excess fluid back into said reservoir.

* * * * *